US005408944A

United States Patent [19]

Hayashi

[11] Patent Number: 5,408,944

[45] Date of Patent: Apr. 25, 1995

[54] WORKING TABLE STRUCTURE FOR A SEWING MACHINE

[75] Inventor: Koji Hayashi, Motosu, Japan

[73] Assignee: Brother Kogyo Kabushiki Kaisha, Nagoya, Japan

[21] Appl. No.: 239,878

[22] Filed: May 9, 1994

[30] Foreign Application Priority Data

May 7, 1993 [JP] Japan ..... 5-131210

[51] Int. Cl.[6] ..... D05C 9/06; D05B 21/00; D05B 25/00

[52] U.S. Cl. ..... 112/103; 112/155

[58] Field of Search ..... 112/103, 102, 121.15, 112/121.12, 155

[56] References Cited

U.S. PATENT DOCUMENTS

| | | | |
|---|---|---|---|
| 4,598,488 | 7/1986 | Inteso | 112/103 X |
| 4,803,937 | 2/1989 | Hiramatsu et al. | 112/121.12 X |
| 5,000,103 | 3/1991 | Beerman | 112/121.15 X |
| 5,249,537 | 10/1993 | Sakakibara | 112/103 |

*Primary Examiner*—Peter Nerbun

*Attorney, Agent, or Firm*—Oliff & Berridge

[57] ABSTRACT

A working table structure is provided for a sewing machine having stitching units arranged on a support frame, a movable frame provided with workpiece holders for holding workpieces and movable in directions parallel to an X-axis perpendicular to the axes of the arms of the stitching units and in directions parallel to a Y-axis perpendicular to the X-axis, and driving mechanisms for driving the movable frame for movement in directions parallel to the X-axis and the Y-axis. The working table structure has at least one working table top disposed above the movable frame in directions parallel to the X-axis and removably supported on the support frame. Since the working table top is disposed above the range of movement of the movable frame with respect to its complete range of movement in directions parallel to the X-axis, the working table top will not interfere with the movable frame. Further, since the working table top is removable, maintenance service for the driving mechanisms can be carried out without any hindrance.

20 Claims, 6 Drawing Sheets

WORKING TABLE STRUCTURE FOR A SEWING MACHINE

BACKGROUND OF THE INVENTION

1. Field of the Invention

The present invention relates to a working table structure for a sewing machine capable of providing an adjacent working surface without interfering with the ranges of movement of a movable frame.

2. Description of Related Art

A multihead embroidery machine provided with a plurality of stitching units is known. Such a multihead embroidery machine is provided with a plurality of stitching units arranged at given intervals on a base frame to stitch the same embroidered patterns simultaneously on flat workpieces with the stitching units. A movable frame for supporting a plurality of embroidery frames holds the workpieces, and an elongate movable frame holds the embroidery frames. A support table supports the movable frame. An X-axis driving mechanism disposed at one end of the support table drives the movable frame for longitudinal movement in directions parallel to an X-axis, which is perpendicular to the axes of the arms of the stitching units. Y-axis driving mechanisms disposed at the opposite ends of the support table drive the movable frame for lateral movement in directions parallel to a Y-axis, which is parallel to the axes of the arms of the stitching units.

It is desirable to incorporate a working table top into the multihead stitching machine for changing the workpieces of the embroidery frames to improve the efficiency of the auxiliary work of changing the workpieces. However, the working table top must not occupy spaces adjacent to the opposite ends of the support table to allow space for the longitudinal movement of the movable frame in directions parallel to the X-axis and space for maintenance service for the X-axis driving mechanism and the Y-axis driving mechanisms. However, space near the opposite ends of the support table for the ranges of movement of the movable frame in directions parallel to the X-axis are generally free and not utilized effectively.

SUMMARY OF THE INVENTION

The present invention has been made to solve at least the foregoing problems. It is therefore an object of the present invention to provide a working table top for a sewing machine capable of effectively utilizing at least a space near one end of a support table supporting a movable frame for the range of movement of the movable frame in directions parallel to an X-axis.

With the above and other objects in view, the present invention provides a working table top structure for a sewing machine having stitching units and a movable frame provided with workpiece holders for holding workpieces. The frame is capable of being moved in directions parallel to a Y-axis, parallel to the axes of the arms of the stitching units, and in directions parallel to an X-axis perpendicular to the Y-axis. The working table top is disposed above the movable frame to allow the movable frame free range of movement in directions parallel to the X-axis.

Since the working table top is disposed above the range of movement of the movable frame provided with the workpiece holders holding workpieces in directions parallel to the X-axis, miscellaneous work can be carried out on the working table top on one end of the support table without obstructing the movement of the movable frame in directions parallel to the X-axis.

BRIEF DESCRIPTION OF THE DRAWINGS

The above and other objects, features and advantages of the present invention will become more apparent from the following description taken in connection with the accompanying drawings, in which.

DESCRIPTION OF PREFERRED EMBODIMENTS

The present invention will be described hereinafter as applied to a multihead embroidery machine M provided with three stitching units MH.

Figure 1:
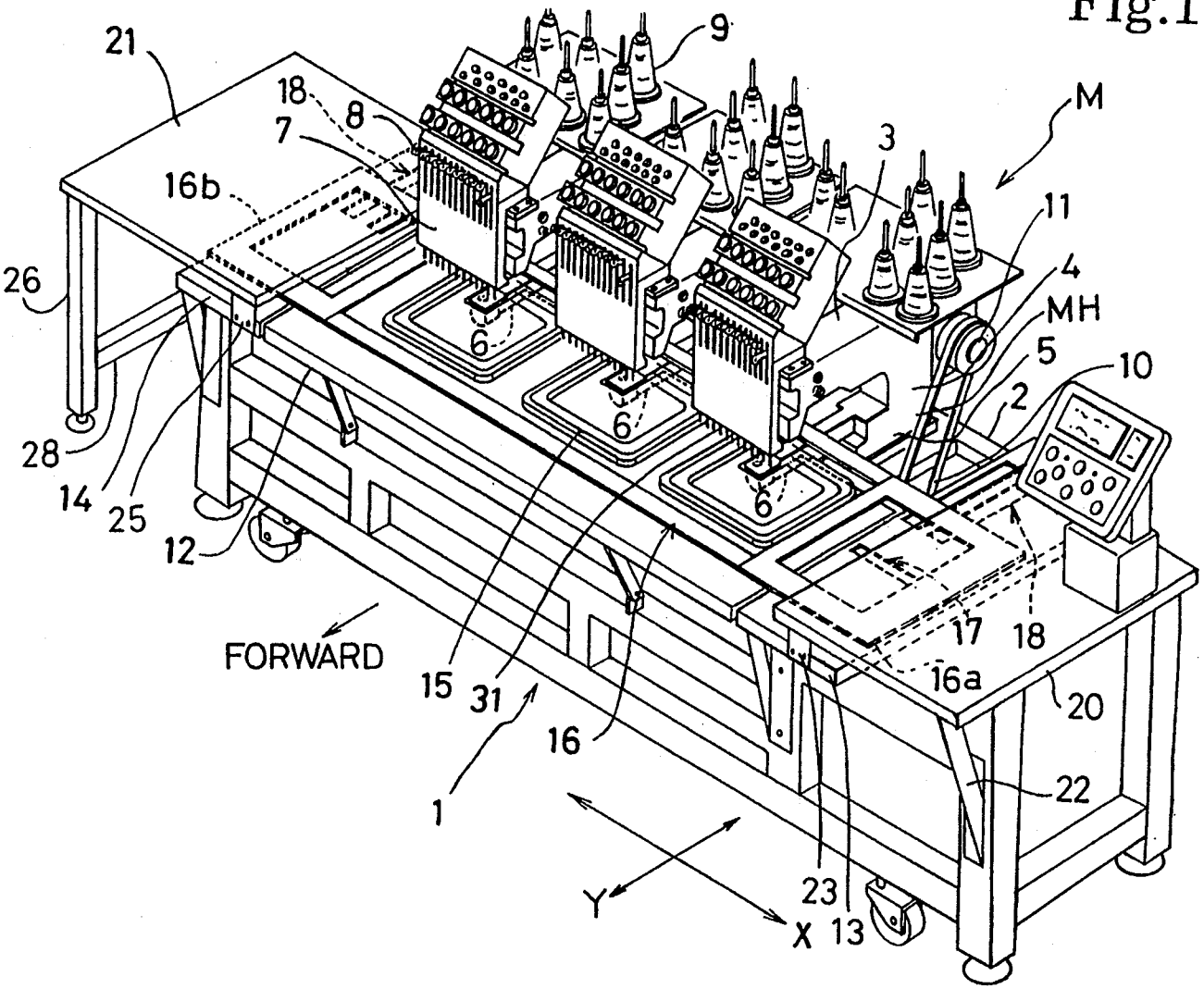
FIG. 1 is a schematic perspective view of a multihead embroidery machine incorporating a working table structure in a preferred embodiment according to the present invention.

Referring to FIG. 1, a longitudinally elongate preferably rectangular base plate 2 having a given length is disposed on the rear part of the upper surface of a base frame 1, and the three stitching units MH having the same construction are arranged longitudinally on the base plate 2 at predetermined intervals. Each stitching unit MH is preferably provided with twelve needle bars supported for vertical reciprocation on the head of an arm 3, and twelve thread takeup levers 8 supported for swing motion on a needle bar case 7 supported on the head of the arm 3 so as to be longitudinally movable in a horizontal plane. The arm 3 is joined to the upper end of a post 4 standing upright on a bed 5 fixed to the base plate 2. A free arm 6 extends forward from the front end of the bed 5, and a rotating hook unit is provided in the front end of the free arm 6.

In each stitching unit MH, a needle 31 is fastened to the lower end of each needle bar, and .twelve embroidery yarns of different colors are supplied to the twelve needles 31 from twelve spools 9, respectively. The needle bar case 7 moves longitudinally, and the needle bars corresponding to the desired embroidery yarns and thread takeup levers 8 selectively drive for vertical movement one at a time to stitch an embroidery of a desired embroidered pattern on the workpiece through the cooperative actions of the needle bars, the needles and the rotating hook unit. A driving shaft 11 drives the arm shaft for vertically reciprocating the needle bars and the thread takeup levers 8 and the bed shaft for rotating the rotating hook unit. The driving shaft 11 is driven for rotation through a V belt 10 by a main motor.

A table top 12 capable of being moved between an upper position and a lower position according to the shape of the workpieces is disposed in the front part of the base plate 2. When located at the upper position, the upper surface of the table top 12 is flush with the upper surface of the free arm 6. A movable frame 16 provided with workpiece holders 15 for holding workpieces is mounted on the table top 12 to extend over a pair of auxiliary table tops 13 and 14 disposed contiguously with the opposite ends of the table top 12, respectively. A right driving frame 16*a* and a left driving frame 16*b* are joined to the right and left ends of the movable frame 16. An X-axis driving mechanism 17 is connected operatively to the right driving frame 16*a* to move the movable frame 16 longitudinally in directions parallel to an X-axis perpendicular to the axes of the arms 3. Y-axis driving mechanisms 18, which operate synchronously, are connected operatively respectively to the right driving frame 16*a* and the left driving frame 16*b* to move the movable frame 16 laterally in directions parallel to a Y-axis, which is perpendicular to the X-axis. The X-axis driving mechanism 17 and the Y-axis driving mechanisms 18 move the movable frame 16 in directions parallel to the X-axis and in directions parallel to the Y-axis, respectively, over the table top 12 and the auxiliary table tops 13 and 14. The right end of the right driving frame 16*a* projects from the right end of the right auxiliary table top 13, and the left end of the left driving frame 16*b* projects from the left end of the left auxiliary table top 14 while the movable frame 16 is moved.

Figure 2:
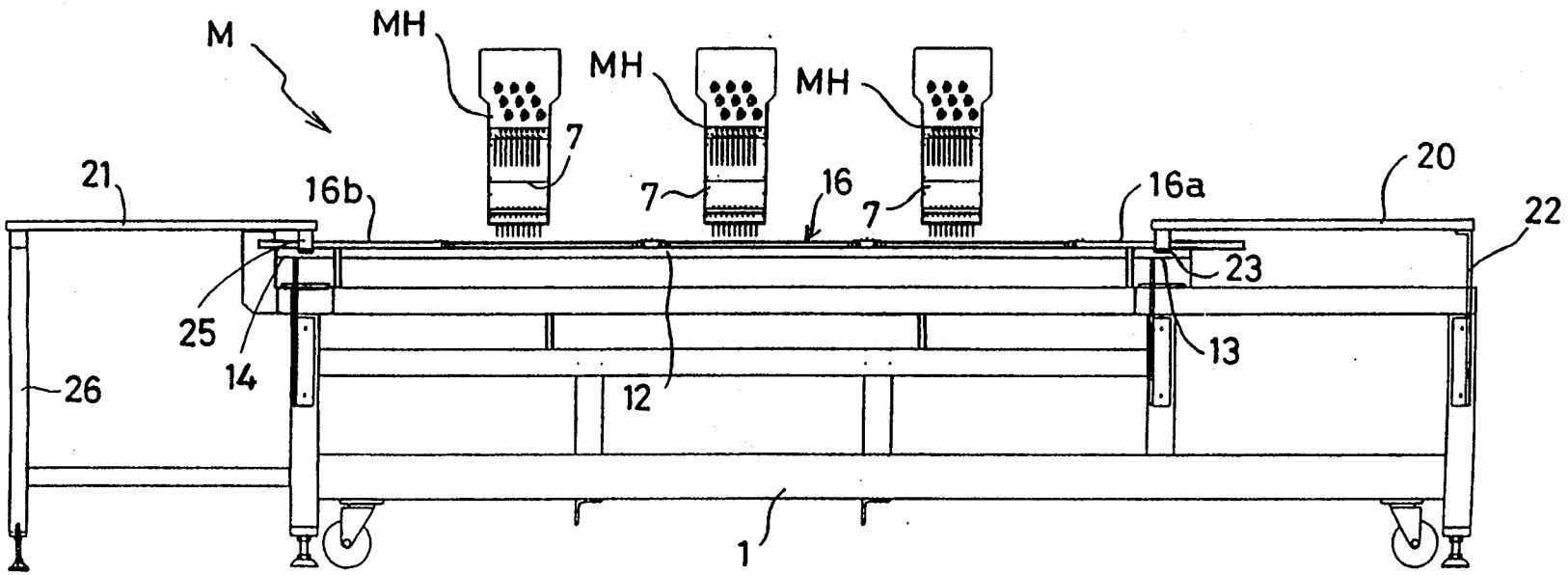
FIG. 2 is a front view of the multihead embroidery machine of FIG. 1.
Figure 3:
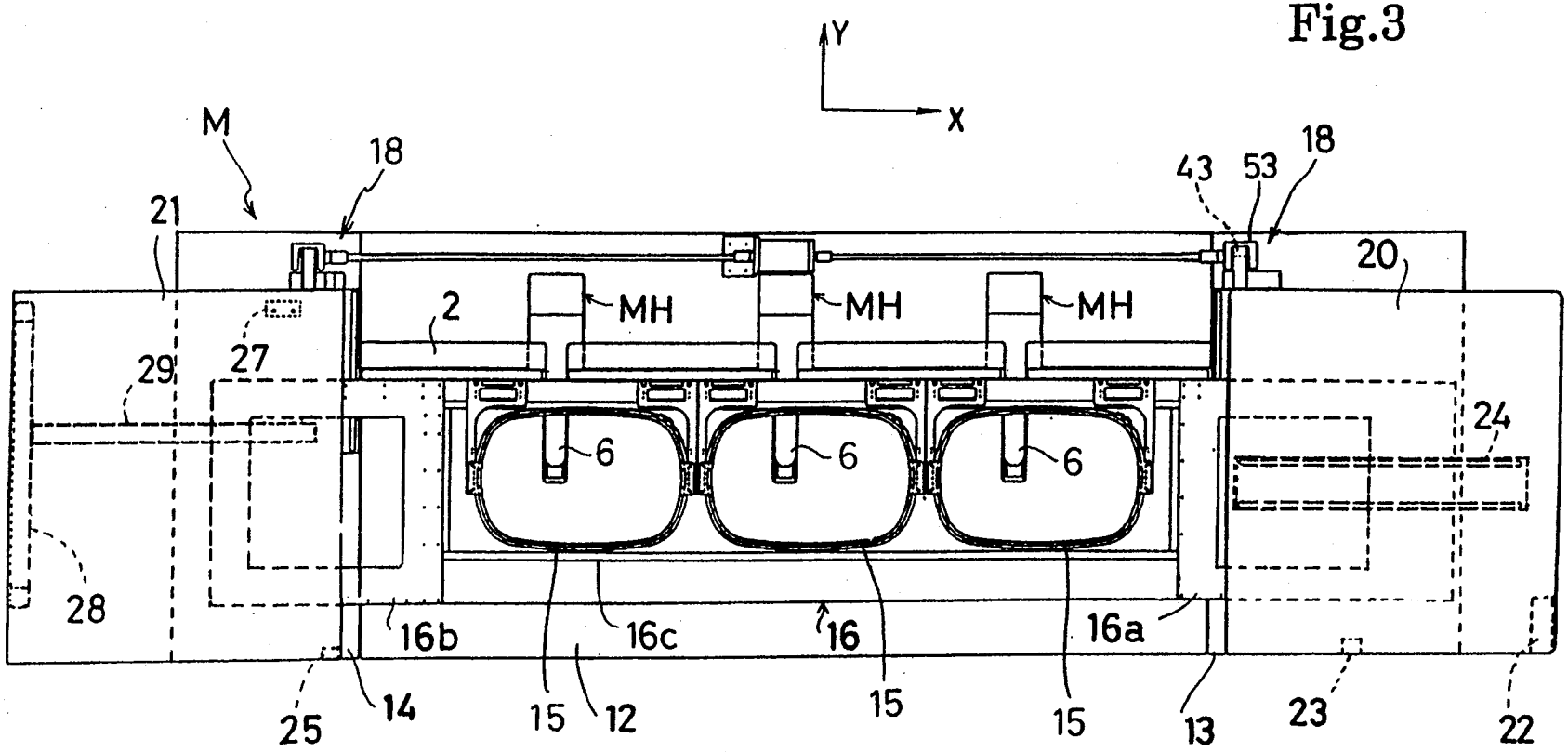
FIG. 3 is a schematic plan view of the multihead embroidery machine of FIG. 1.

As shown in FIGS. 2 and 3, a right working table top 20 and a left working table top 21 extend respectively over the right auxiliary table top 13 and the left auxiliary table top 14. The working table tops 20 and 21 are disposed at a predetermined distance from the upper surfaces of the auxiliary table tops 13 and 14 so as not to obstruct the movement of the movable frame 16 over the auxiliary table tops 13 and 14. The right working table top 20 is disposed above an X-axis moving range, in which the right driving frame 16*a* moves, so as not to interfere with the right driving frame 16*a*. The right working table top 20 has a right end supported on the right legs of the base frame 1 and is fastened, preferably with screws, to an oblique support stay 22 fixed to the right leg of the base frame 1. The left end of the right working table top 20 is fastened, preferably with screws, to a bracket 23 fixed to the auxiliary table top 13. The right working table top 20 is reinforced with a reinforcing plate 24, shown in FIG. 3, attached to its lower surface. The left working table top 21 is disposed above the X-axis moving range, in which the left driving frame 16*b* moves, so as not to interfere with the left driving frame 16*b*. The left working table top 21 has a left end supported at its front and rear ends on a pair of adjustable legs 26, and a right end fastened, preferably with screws, to brackets 25 and 27 fixed to the left auxiliary table top 14. The upper ends of the pair of legs 26 are interconnected by a crosspiece 28 extended along the lower surface of the left working table top 21 to reinforce the pair of legs 26, and the crosspiece 28 is connected by a longitudinal crosspiece 29 extending along the lower surface of the left working table top 21 to the base frame 1. Both the working table tops are removable.

The mechanisms for moving the movable frame 16 will be described hereinafter with reference to FIG. 4. A holding frame 16*c* for holding the workpiece holders 15 is fixed to the upper surface of the movable frame 16 between the driving frames 16*a* and 16*b*. The movable frame 16 and the driving frames 16*a* and 16*b* each have a U-shaped cross section opening downward. A straight first roller guide groove 81 is formed in the lower surfaces of the movable frame 16 and the driving frames 16*a* and 16*b* to extend from the right extremity of the right driving frame 16*a* to the left extremity of the left driving frame 16*b*. A straight second roller guide groove 82, perpendicular to the first roller guide groove 81, is formed in the lower surface of the right driving frame 16*a*.

Referring again to FIG. 4, the X-axis driving mechanism 17 has an X-axis driving motor 84, i.e., a stepping motor, installed on the right end of a base frame 83 extended below the table top 12 and the auxiliary table tops 13 and 14, a pair of timing belt pulleys 85 and 86, a timing belt 33 extended between the timing belt pulleys 85 and 86, and an X-axis carriage 34 connected to the timing belt 33. The timing belt pulley 85 is driven by the X-axis driving motor 84. Guide rollers 35 and 36 are held rotatably on the upper surface of the X-axis carriage 34 so as to roll along the second roller guide groove 82 of the driving frame 16*a*. The X-axis carriage 34 is guided by an X-axis guide mechanism 37 for movement along a straight path parallel to the X-axis.

Figure 4:
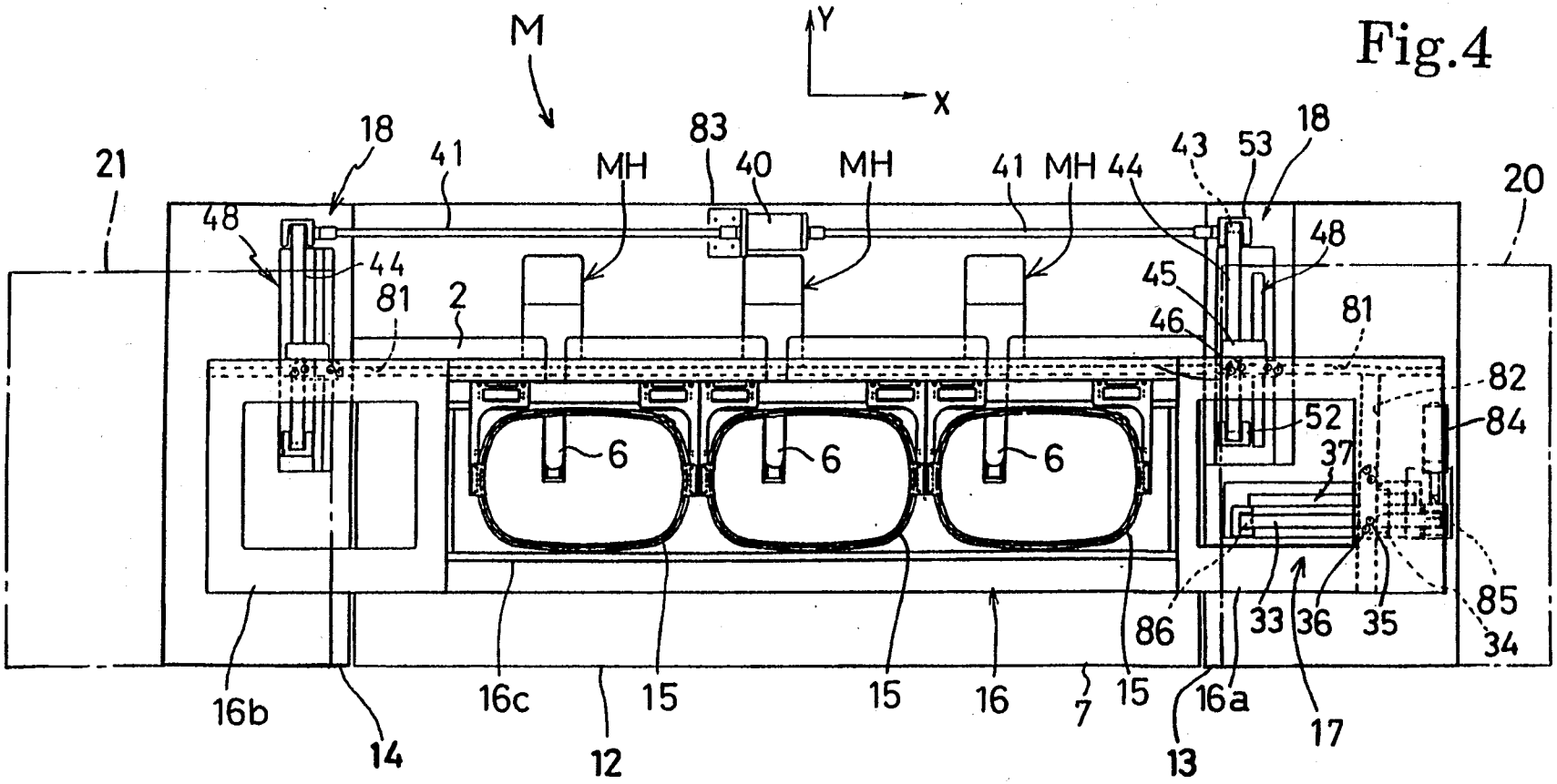
FIG. 4 is a schematic plan view of the multihead embroidery machine of FIG. 1, in which the working table structure is omitted.

As shown in FIG. 4, the Y-axis driving mechanisms 18 having the same construction are disposed respectively on the opposite ends of the base frame 83 and are driven by a Y-axis driving motor 40, i.e., a stepping motor, disposed on the rear middle part of the base frame 83. Each Y-axis driving mechanism 18 has a pair of timing belt pulleys 42 and 43, and a timing belt 44 extended between the timing belt pulleys 42 and 43. The timing pulley 43 is fixedly mounted on a transmission shaft 41, which is driven for rotation by the Y-axis driving motor 40. A Y-axis carriage 45 is connected to the timing belt 44, and guide rollers 46 and 47 are supported for rotation on the upper surface of the Y-axis carriage 45 to roll along the first roller guide groove 81. Each Y-axis carriage 45 is guided by a Y-axis guide mechanism 48 for movement along a straight path parallel to the Y-axis.

Figure 5:
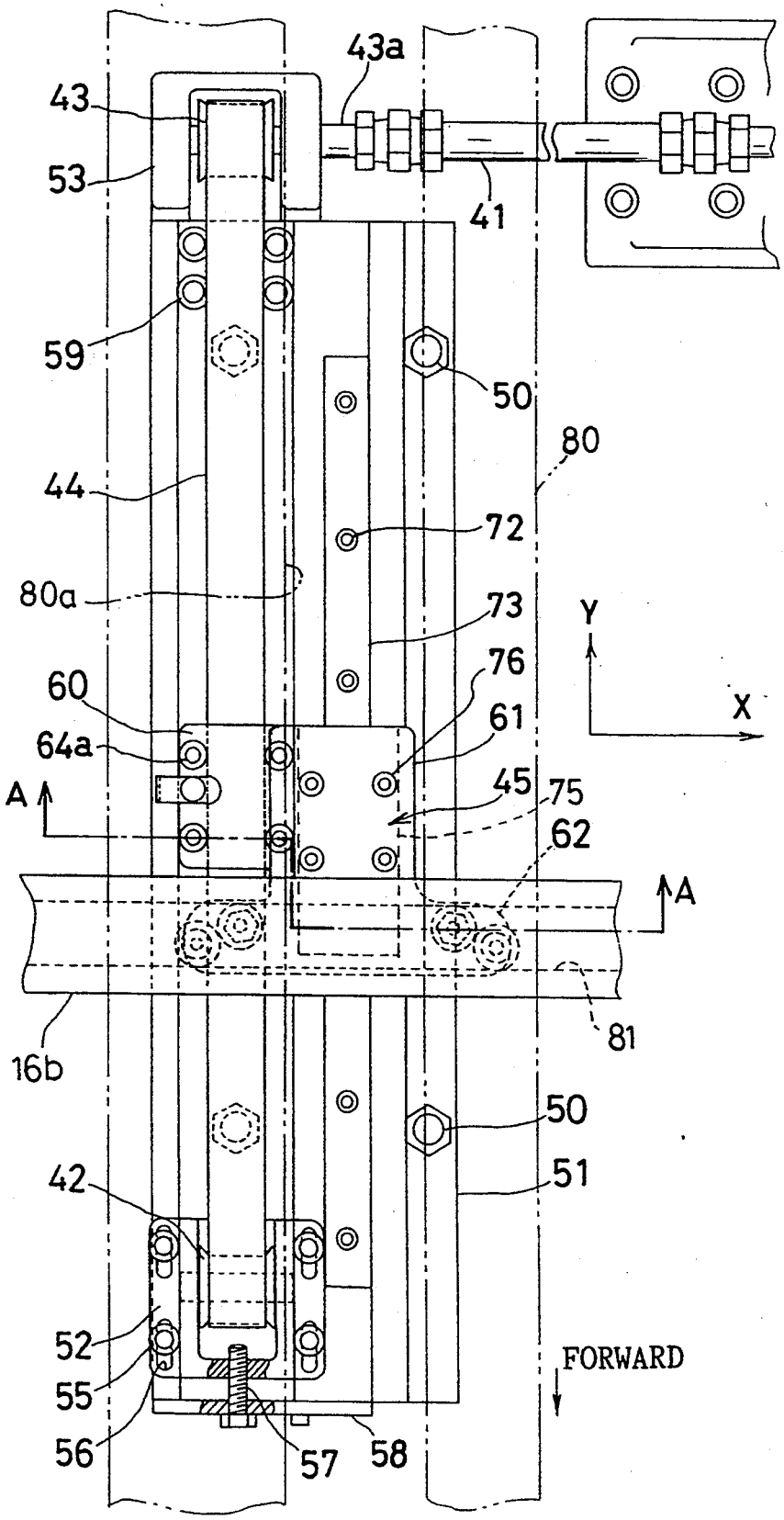
FIG. 5 is an enlarged plan view of an essential part of a Y-axis driving mechanism.

The X-axis driving mechanism 17 and the Y-axis driving mechanisms 18 are substantially the same in construction, and, hence, only the left Y-axis driving mechanism 18 is described in detail. Referring to FIGS. 4 and 5, a base member 51 is fastened to the base frame 83 with bolts 50. Substantially U-shaped pulley support members 52 and 53 are attached to the opposite ends of the base member 51 with respect to the Y-axis, and the timing belt pulleys 42 and 43 are journaled respectively on the pulley support members 52 and 53. The front pulley support member 52 is fastened to the base member 51 with bolts screwed through slots 56 formed in the base member 51 in the front pulley support member 52, and a tension adjusting bolt 57 having a head resting on a front vertical wall 58 of the base member 51 is screwed in the front wall of the front pulley support member 52 to change the position of the front pulley support member 52 with respect to the direction parallel to the Y-axis. When adjusting the tension of the timing belt 44, the bolts 55 are loosened and the tension adjusting bolt 57 is turned to change the position of the front pulley support member 52 with respect to the direction parallel to the Y-axis. The rear pulley support member 53 is fixed to the base member 51 with bolts 59. The shaft 43a of the timing pulley 43 supported on the rear pulley support member 53 projects from the side wall of the rear pulley support member 53 and is connected to the transmission shaft 41.

Figure 6:
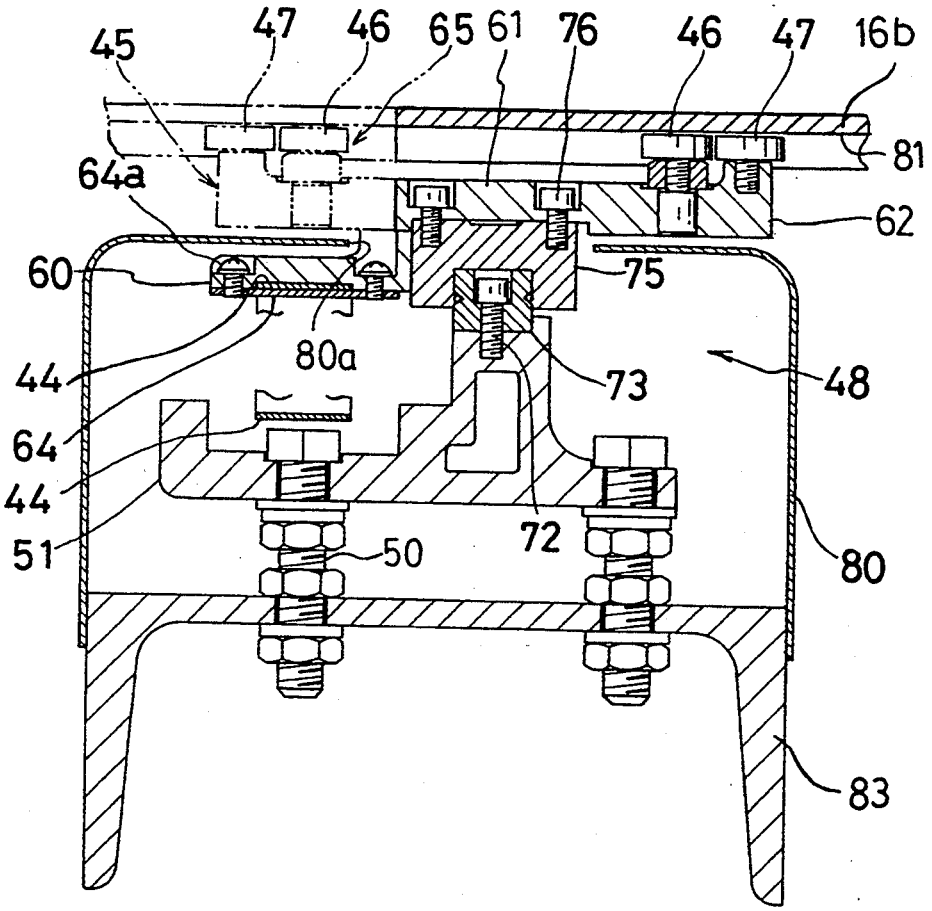
FIG. 6 is a longitudinal sectional view taken on line A—A in FIG. 5.

Referring to FIGS. 5 and 6, the Y-axis carriage 45 has a carriage block 61 supporting the movable frame 16, so that the movable frame 16 is movable relative thereto, and a linear slide block 75 attached to the lower surface of the carriage block 61 and slidably mounted on a guide rail 73. A connecting member 60 is attached to the linear slide block 75 to lie in a plane below the carriage block 61. As shown in FIG. 6, a fastening plate 64 is applied to the underside of the upper run of the timing belt 44. The fastening plate 64, part of the timing belt 44 and the connecting member 60, are fastened together with screws 64*a* to hold part of the timing belt 44 fixedly between the fastening plate 64 and the connecting member 60. As shown in FIGS. 5 and 6, a bracket 62, which is elongate along the direction of the X-axis, projects horizontally forward from the carriage block 61, and the pair of guide rollers 46 and 47 are supported pivotally on each end of the bracket 62. The guide rollers 46 and 47 are shifted relative to each other with respect to the direction of the Y-axis so that one of the guide rollers 46 and 47 is in rolling contact with one side surface of the first roller guide groove 81 and the other is in rolling contact with the other side surface of the first roller guide groove 81.

The Y-axis guide mechanism 48 is described with reference to FIG. 6. The guide rail 73 is fastened to the base frame with screws 72 in parallel to the timing belt 44 extended in parallel to the direction of the Y-axis. The guide block 75 fastened to the lower surface of the Y-axis carriage 45 with the bolts 72 is mounted slidably on the guide rail 73.

A cover 80 having a cross section resembling the inverted letter U is placed on the base frame 83 to cover the Y-axis driving mechanism 18 and the Y-axis guide mechanism 48. The upper surface of the cover 80 extends below the carriage block 61, and the upper wall of the cover 80 is provided with an elongate opening 80*a* to enable the guide block 75 holding the carriage block 61 to move along a path parallel to the Y-axis in the elongate opening 80*a*. Thus, the workpiece holders 15 mounted on the movable frame 16 are disposed at a height from the upper surface of the cover 80 equal to the height of the Y-axis carriage 45. Likewise, the right Y-axis driving mechanism 18 and the right Y-axis guide mechanism 48 are covered with a cover, not shown, similar to the cover 80. Also, the X-axis driving mechanism 17 and the X-axis guide mechanism 37 are covered with a cover, not shown.

Functions of the working table tops 20 and 21 are described hereinafter. Since the working table tops 20 and 21 are disposed above the X-axis moving ranges of the driving frames 16*a* and 16*b* on the opposite ends of the movable frame 16, respectively, the working table tops 20 and 21 will not interfere with the movable frame 16. Further, the working table tops 20 and 21 provide surfaces for efficient miscellaneous work and utilize the spaces over the X-axis moving ranges of the driving frames 16*a* and 16*b* effectively. Since the working table tops 20 and 21 are removable, the working table tops 20 and 21 are removed from the multihead embroidery machine M when the X-axis driving mechanism 17 and the Y-axis driving mechanisms 18 need maintenance service to carry out the maintenance service without any hindrance. The working table tops 20 and 21 serve also as guard means for protecting the operator from being injured by the moving driving frames 16*a* and 16*b* of the movable frame 16. Alternatively, multihead embroidery machine M may be provided with only either the right working table top 20 or the left working table top 21. Naturally, the present invention is applicable to sewing machines other than the multihead embroidery machine M.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A sewing machine assembly comprising:

a movable frame means having a workpiece holding means for holding a workpiece;

a stitching means including an arm supporting a needle bar to which a needle is mounted for forming stitches on the workpiece;

a driving means for driving the movable frame means in a direction parallel to a Y-axis, which is parallel to the arm of the stitching means, and in a direction parallel to an X-axis, which is perpendicular to the Y-axis;

a working table means having a lower surface and having an upper surface for providing an open working surface; and a supporting means for supporting the movable frame means and for supporting the working table means above the movable frame means wherein the loer surface of the working table means overlies a portion of the movable frame to allow free range of movement of the movable frame beneath the lower surface of the working table means in a direction parallel to the X-axis and so as not interfere with the movable frame means.

2. The sewing machine assembly as claimed in claim 1, wherein the supporting means includes a base table means on which the movable frame means is supported and the workpiece holding means is disposed.

3. The sewing machine assembly as claimed in claim 2, wherein the supporting means supports the working table means detachably.

4. The sewing machine assembly as claimed in claim 3, wherein the driving means includes maximum moving means for moving the movable frame means to a position projecting from an end of the base table means in a direction parallel to the X-axis.

5. The sewing machine assembly as claimed in claim 4, wherein the driving means moves the movable frame means between a maximum right position and a maximum left position, a right end of the movable frame means projecting from a right end of the base table means at the maximum right position and a left end of the movable frame means projecting from a left end of the base table means at the maximum left position.

6. The sewing machine assembly as claimed in claim 5, wherein the movable frame means includes a driving frame means connected to a first side of the workpiece holding means and extending in a direction parallel to the X-axis, wherein the driving means drives the movable frame means by moving the driving frame means.

7. The sewing machine assembly as claimed in claim 6, wherein the driving means is disposed below the working table means and is connected to the driving frame means.

8. The sewing machine assembly as claimed in claim 7, wherein the driving means includes a carriage means for carrying the movable frame means and a guide means for guiding the carriage means, the guide means being provided on the driving frame means and extending perpendicular to the direction in which the driving frame means is moved by the carriage means.

9. The sewing machine assembly as claimed in claim 8, wherein the carriage means includes a roller means guided along the guide means.

10. The sewing machine assembly as claimed in claim 9, wherein the driving means further includes first and second pairs of carriage means for carrying the movable frame means and guide means for guiding the carriage means, the first pair being for moving the driving frame means in the direction parallel to the Y-axis and the second pair for moving the driving frame means in the direction parallel to the X-axis.

11. The sewing machine assembly as claimed in claim 10, wherein the guide means is provided on a lower surface of the driving frame means.

12. The sewing machine assembly as claimed in claim 11, wherein the guide means includes a guide groove for guiding the roller means therein.

13. The sewing machine assembly as claimed in claim 12, wherein the driving means includes a motor and a transmitting means for transmitting rotation of the motor to the carriage means.

14. The sewing machine assembly as claimed in claim 13, wherein the workpiece holding means includes a embroidery frame means for holding a workpiece for embroidery.

15. The sewing machine assembly as claimed in claim 13, wherein the driving means is disposed in its entirety below the driving frame means.

16. The sewing machine assembly claimed as in claim 15, wherein the movable frame means includes an additional driving frame means connected to a second side of the workpiece holding means and extending in the direction parallel to the X-axis, the second side being opposite to the first side to which the other driving frame means is connected, and wherein the driving means further includes a third pair of the carriage means and the guide means for moving the driving frame means in the direction parallel to the Y-axis, the driving means driving the movable frame means by moving each of the driving frame means respectively with each of the first and the third pairs of the carriage means and the guide means.

17. The sewing machine assembly as claimed in claim 16, further comprising an additional working table means supported by the supporting means above the additional driving frame means in the directions parallel to the X-axis so as not to interfere with the additional driving frame means.

18. The sewing machine assembly as claimed in claim 17, wherein the driving means is also disposed below the additional driving frame means.

19. The sewing machine assembly as claimed in claim 9, wherein the guide means includes a guide groove for guiding the roller means therein.

20. A sewing machine assembly comprising:

a movable frame having a workpiece holding frame for holding a workpiece;

a stitching mechanism including an arm supporting a needle bar to which a needle is mounted for forming stitches on the workpiece;

a driving mechanism for driving the movable frame in a direction parallel to a Y-axis, which is parallel to the arm of the stitching mechanism, and in a direction parallel to an X-axis, which is perpendicular to the Y-axis;

a working table having a lower surface and having a top providing an open working surface; and a supporting frame supporting the movable frame and supporting the working table top to overlie the movable frame, wherein the lower surface of the working table overlies a portion of the movable frame to allow free movement of the movable frame in a direction parallel to the X-axis by permitting portions of the movable frame to pass beneath the working table top so as to not interfere with the movable frame.

* * * * *